US006648689B1

(12) United States Patent
Billman et al.

(10) Patent No.: US 6,648,689 B1
(45) Date of Patent: Nov. 18, 2003

(54) HIGH DENSITY ELECTRICAL CONNECTOR HAVING ENHANCED CROSSTALK REDUCTION CAPABILITY

(75) Inventors: Timothy B. Billman, Dover, PA (US); Eric D. Juntwait, Hummelstown, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/165,596

(22) Filed: Jun. 7, 2002

(51) Int. Cl.[7] ..... H01R 13/648
(52) U.S. Cl. ..... 439/608; 439/108
(58) Field of Search ..... 439/608, 108, 439/101, 79, 701, 76.1

(56) References Cited

U.S. PATENT DOCUMENTS

| | | | | |
|---|---|---|---|---|
| 5,980,321 | A | * 11/1999 | Cohen et al. | 439/608 |
| 6,152,747 | A | 11/2000 | McNamara | |
| 6,174,202 | B1 | * 1/2001 | Mitra | 439/608 |
| 6,220,896 | B1 | * 4/2001 | Bertoncini et al. | 439/608 |
| 6,267,604 | B1 | * 7/2001 | Mickievicz et al. | 439/79 |
| 6,293,827 | B1 | * 9/2001 | Stokoe | 439/608 |
| 6,299,484 | B2 | * 10/2001 | Van Woensel | 439/608 |
| 6,338,635 | B1 | 1/2002 | Lee | |
| 6,390,857 | B1 | * 5/2002 | Pickles et al. | 439/680 |

OTHER PUBLICATIONS

PCB–Mounted Receptacle Assemblies, Berg Product Catalog, Jan. 1998, pp. 10–6 to 10–7 and pp.10–16 to 10–17.
VHDM Connector, http://www.teradyne.com/prods/tcs/products/hpi/vhdm/modoconfig.html.

* cited by examiner

*Primary Examiner*—Gary Paumen
*Assistant Examiner*—James R. Harvey
(74) *Attorney, Agent, or Firm*—Wei Te Chung

(57) ABSTRACT

An electrical connector (1) includes a number of individual wafers (21) assembled together to define a number of slots (200) therebetween for receiving a number of circuit boards (30) in the slots. Each wafer includes a dielectric base (22) and a number of signal contacts (23) and a grounding bus (24) respectively mounted on opposite sides of the dielectric base. Each grounding bus has a number of flaps (247) adjacent to a bottom edge thereof. Each signal contact has a tail portion (232) for electrically engaging with a printed circuit board on which the connector is mounted, and an end portion (236) located near the tail portion and aligned with a corresponding flap of the grounding bus. The flaps are disposed between the end portions of the signal contacts of adjacent rows for functioning as shielding between the end portions, thereby ensuring better signal transmission performance of the connector.

1 Claim, 12 Drawing Sheets

HIGH DENSITY ELECTRICAL CONNECTOR HAVING ENHANCED CROSSTALK REDUCTION CAPABILITY

CROSS-REFERENCES TO RELATED APPLICATIONS

This patent application is an Co-pending application of patent applications with Ser. No. 10/154,318 filed on May 22, 2002, entitled "HIGH DENSITY ELECTRICAL CONNECTOR", invented by Timothy Brain Billman; with Ser. No. 10/162,764 filed on Jun. 4, 2002, entitled "ELECTRICAL CONNECTOR WITH LEAD-IN DEVICE", invented by Timothy Brain Billman and Iosif korsunsky with Ser. No. 10/162,071 filed May 30, 2002, entitled "ELECTRICAL CONNECTOR, WITH IMPROVED GROUNDING BUS", invented by Timothy Brain Billman and Iosif korsunsky; and with Ser. No. 10/165,561 filed on the same date with the instant invention, entitled "HIGH SPEED, HIGH DENSITY BACKPLANE CONNECTOR", invented by Timothy Brain Billman, all assigned to the same assignee and filed on the same date with this application.

BACKGROUND OF THE INVENTION

1. Field of the Invention

The present invention relates to a high density electrical connector, and particularly to a high density electrical connector having improved grounding buses for reducing electrical crosstalk between signal terminals.

2. Description of Related Art

With the development of communication and computer technology, high density electrical connectors with conductive elements in a matrix arrangement are desired to thereby construct a large number of signal transmitting paths between two electronic devices. Such high density electrical connectors are widely used in internal connecting systems of severs, routers and the like devices requiring high speed data processing and communication. These connectors can be referred to Berg Product Catalog published on January 1998, entitled "PCB-mounted receptacle assemblies", which is submitted herewith by Information Disclosure Statement (IDS), and the website of Teradyne, Inc, at the following internet address: http://www.teradyne.com/prods/tcs/products/hpi/vhdm/modoconfig.html. U.S. Pat. Nos. 6,267,604, 5,980,321, 6,293,827 and 6,299,484 also disclose such high density electrical connectors.

Because the signal transmission speed of these high density electrical connectors is very fast, crosstalk between signal transmitting paths becomes a serious problem. U.S. Pat. No. 6,338,635, issued to Wei-Chen Lee and assigned to Hon Hai Precision Ind. Co., Ltd., discloses an electrical connector that adopts a grounding bus for promoting high quality signal transmission therethrough. The electrical connector comprises an insulative housing defining a cavity in a top face thereof and a plurality of passageways in a bottom face thereof communicating with the cavity, and a plurality of terminals and modules retained in the housing. Each module includes an insulative body and a grounding member attached on a first side of the body. In assembly, the modules are first downwardly inserted into the cavity of the housing, and the terminals are then upwardly inserted into the passageways of the housing to be positioned in an opposite second side of the body of the module. The grounding member forms a plurality of projections extending into the body toward the second side for preventing crosstalk between adjacent terminals of a common row. However, assembling the terminals and the modules into the housing is complicated. In addition, the terminals inserted into the housing must be accurately positioned in the second side of the body of the module, thereby increasing difficulty of assemblage. Thus, the manufacturing cost of the connector is correspondingly increased.

U.S. Pat. No. 6,152,747, issued to Teradyne, Inc., discloses a high density electrical connector comprising a dielectric housing defining a plurality of parallel slots therein and a plurality of wafer-like modules retained in respective slots. Each wafer-like module includes a dielectric support and a plurality of signal contacts and a grounding plate attached at opposite sides of the dielectric support, respectively. Mounting portions of the signal contacts and the grounding plate of the wafer-like module are arranged in a staggered manner for connecting to a printed circuit board on which the connector is mounted. Obviously, the grounding plates function as shielding for reducing crosstalk between adjacent rows of the signal contacts. However, there is no shielding between the mounting portions of the signal contacts of the adjacent rows, so crosstalk between the adjacent rows of the signal contacts is not effectively reduced, thereby adversely affecting signal transmission performance of the connector. U.S. Pat. No. 6,174,202 also discloses some approach.

Hence, an electrical connector with improved grounding bus is required to overcome the disadvantages of the related art.

SUMMARY OF THE INVENTION

Accordingly, a first object of the present invention is to provide a high density electrical connector having improved grounding buses for effectively preventing crosstalk between adjacent rows of signal contacts.

A second object of the present invention is to provide a high density electrical connector having grounding buses disposed between adjacent rows of signal contacts, each grounding bus having a plurality of flaps for ensuring better signal transmission performance of the connector.

In order to achieve the objects set forth, a high density electrical connector in accordance with the present invention comprises a plurality of individual wafers assembled together to define slots therebetween for receiving a plurality of circuit boards in the slots. Each wafer includes a dielectric base and a plurality of signal contacts and a grounding bus respectively mounted on opposite sides of the dielectric base. Each grounding bus forms a plurality of flaps adjacent to a bottom edge thereof. Each signal contact has a tail portion adapted for electrically contacting with a printed circuit board on which the electrical connector is mounted, and an end portion located near the tail portion thereof and aligned with a corresponding flap of the grounding bus. The flaps are disposed between the end portions of the signal contacts of adjacent rows for functioning as shielding between the end portions, thereby ensuring better signal transmission performance of the connector.

Other objects, advantages and novel features of the invention will become more apparent from the following detailed description when taken in conjunction with the accompanying drawings.

DETAILED DESCRIPTION OF THE INVENTION

Figure 1:
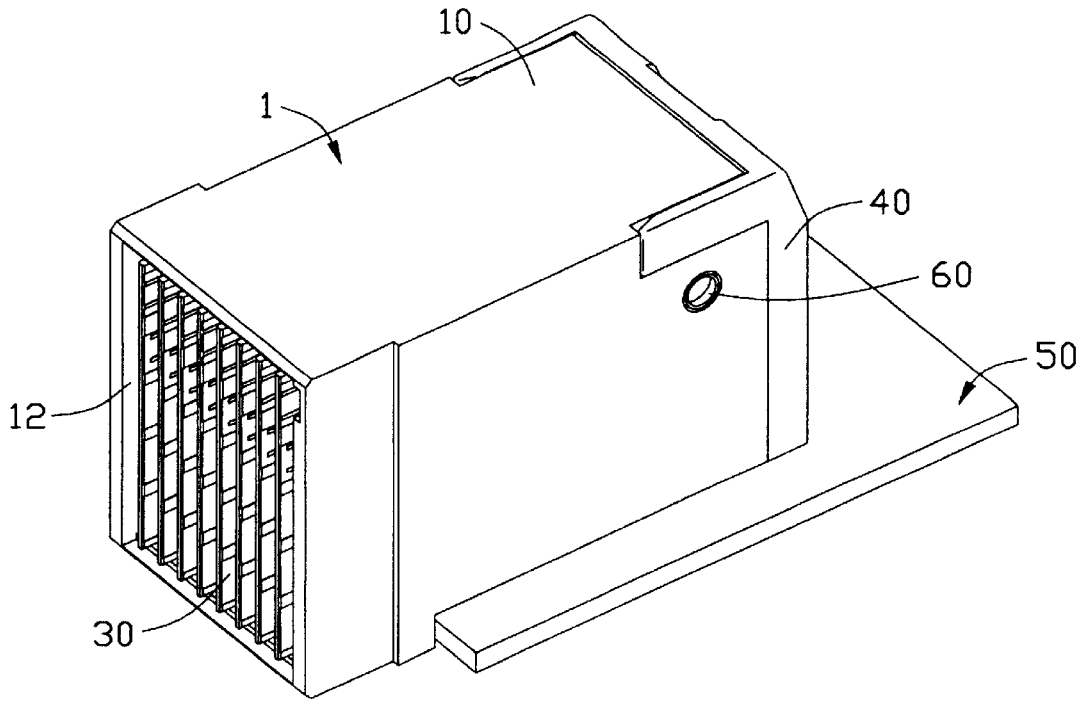
FIG. 1 is a perspective view of an electrical connector and a daughter card on which the connector is mounted in accordance with the present invention.

Referring to FIGS. 1–5, an electrical connector 1 mounted on a daughter card 50 in accordance with the present invention comprises a dielectric housing 10, a spacer 20, a plurality of circuit boards 30 retained between the housing 10 and the spacer 20, and a fastening device 40 for securing the spacer 20 to the housing 10. Each of the circuit boards 30 includes a dielectric substrate made of conventional circuit board substrate material, such as FR4, a plurality of conductive signal and grounding traces on one side of the substrate for providing electrical paths through the connector 1, and a layer of conductive material coated on an opposite side of the substrate for providing a grounding plane to the circuit board 30.

Figure 6:
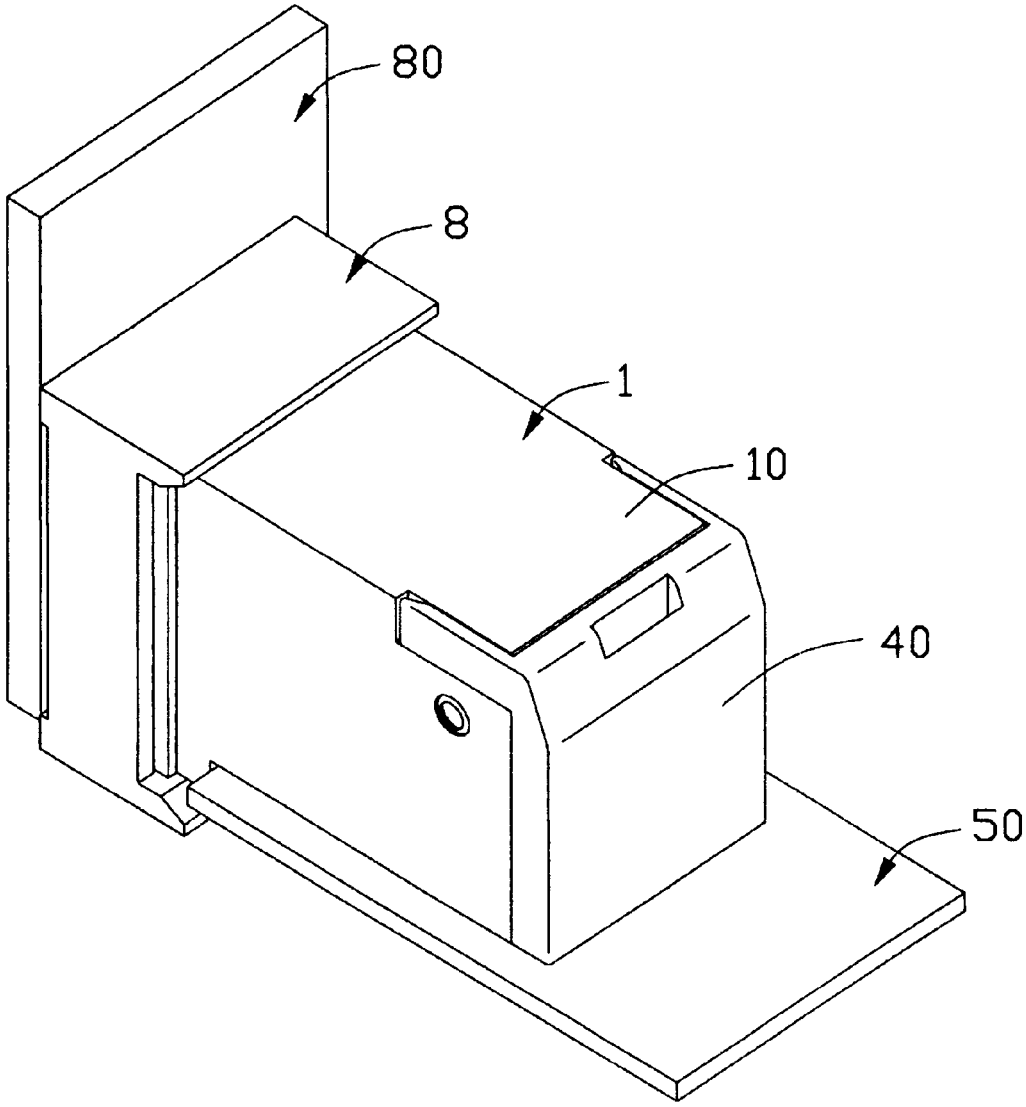
FIG. 6 is a perspective view showing the connector of the present invention and the complementary connector in a mated condition.

The dielectric housing 10 is generally rectangular in shape. The housing 10 defines a front mating port 12 facing a complementary connector 8 (shown in FIG. 5) for connecting with a backplane 80 (FIG. 6). The connector 1 and the complementary connector 8, shown in a mated condition in FIG. 6, serve to interconnect the daughter card 50 with the backplane 80. The housing 10 defines an opening 13 in a bottom face 100 and a rear face 102 thereof, and a plurality of parallel channels 14 in communication with the opening 13. The channels 14 extend in a longitudinal direction of the housing 10 between the front mating port 12 and the rear face 102. The housing 10 defines a pair of recesses 15 in top, rear corners thereof, respectively, and a pair of cavities 16 further recessed from the recesses 15, respectively. An aperture 17 is defined transversely through the opposite side faces 104 of the housing 10 near the rear face 102.

The spacer 20 consists of a plurality of wafers 21. In the preferred embodiment, each one of the wafers 21 is substantially identical in construction, an exemplary one thereof being shown in FIGS. 7 and 8. Each wafer 21 includes a dielectric base 22 and a plurality of signal terminals 23 and a grounding bus 24 respectively mounted on opposite sides of the base 22. The dielectric base 22 has a body portion 220 and front and rear end portions 222, 223. The rear end portion 223 has a top portion projecting upwardly beyond a top edge 224 of the body portion 220 to thereby form a shoulder 2220. The rear end portion 223 further defines a depression 2222 in a rear side thereof.

The body portion 220 of the dielectric base 22 has substantially planar side surfaces 2200, 2202. The body portion 220 forms a plurality of first and second blocks 25, 26 respectively on lower parts of the side surfaces 2202, 2200. The first and the second blocks 25, 26 are located adjacent to a bottom surface 2204 of the body portion 220 in a staggered manner. Bottom faces of the first and the second blocks 25, 26 are flush with the bottom surface 2204 of the body portion 220 of the dielectric base 22. Each second block 26 includes a rib 262 between two neighboring signal terminals 23, and an embossment 264 located generally in a middle thereof. The side surface.2200 of the body portion 220 of the dielectric base 22 defines a plurality of slots 27 extending through the second blocks 26 to thereby run through a whole height of the body portion 220. The side surface 2200 of the dielectric base 22 also defines a plurality of recesses 28 adjacent to the top edge 224 of the body portion 220 and between every two slots 27.

Figure 7:
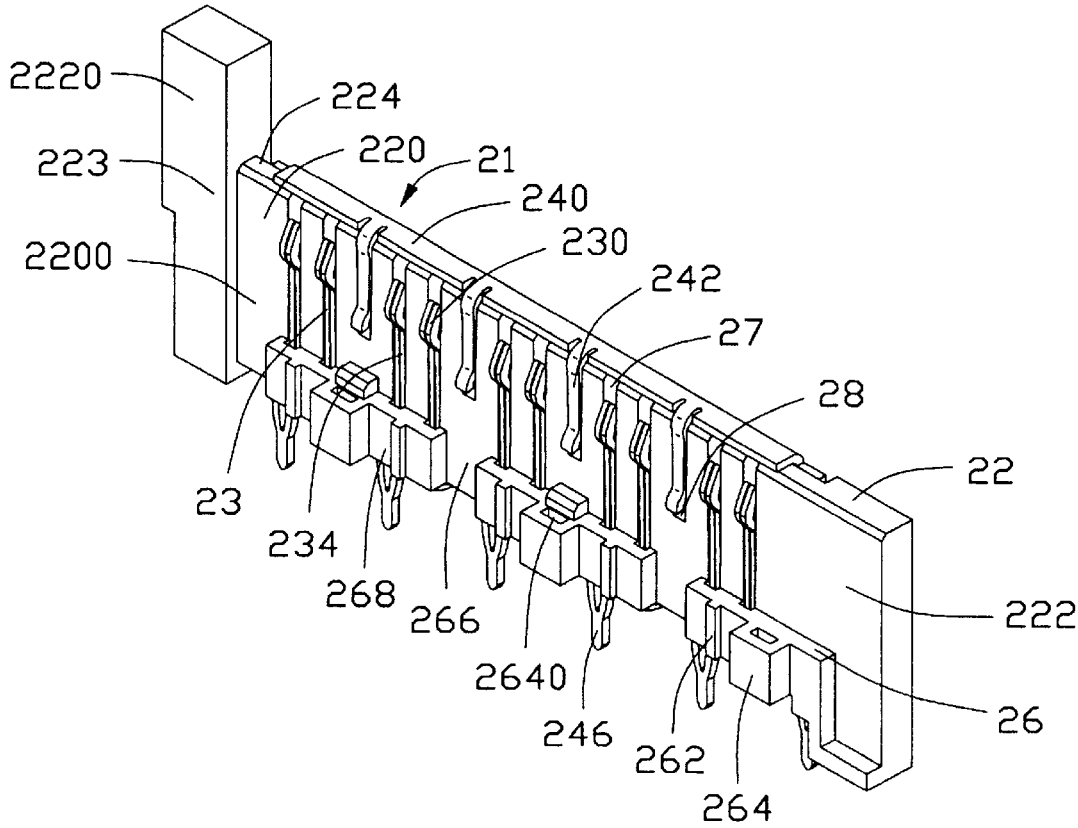
FIG. 7 is an enlarged perspective view of a wafer of the connector of the present invention.
Figure 8:
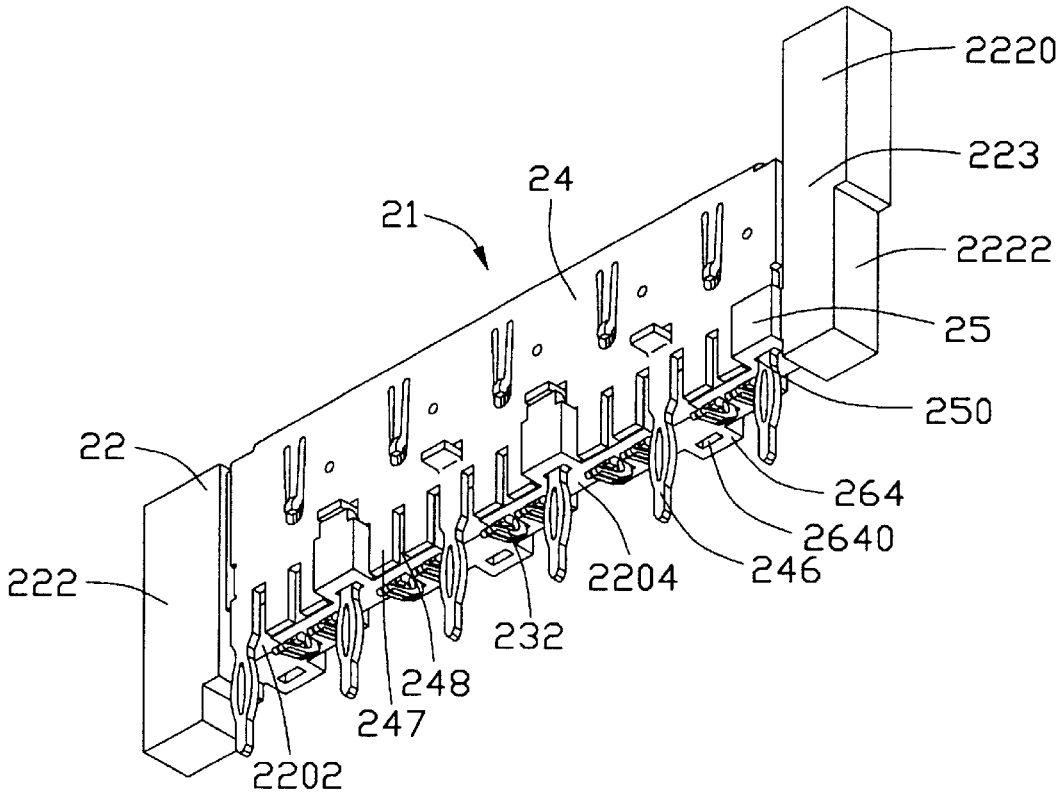
FIG. 8 is a view similar to FIG. 7 but taken from a different perspective.
Figure 9:
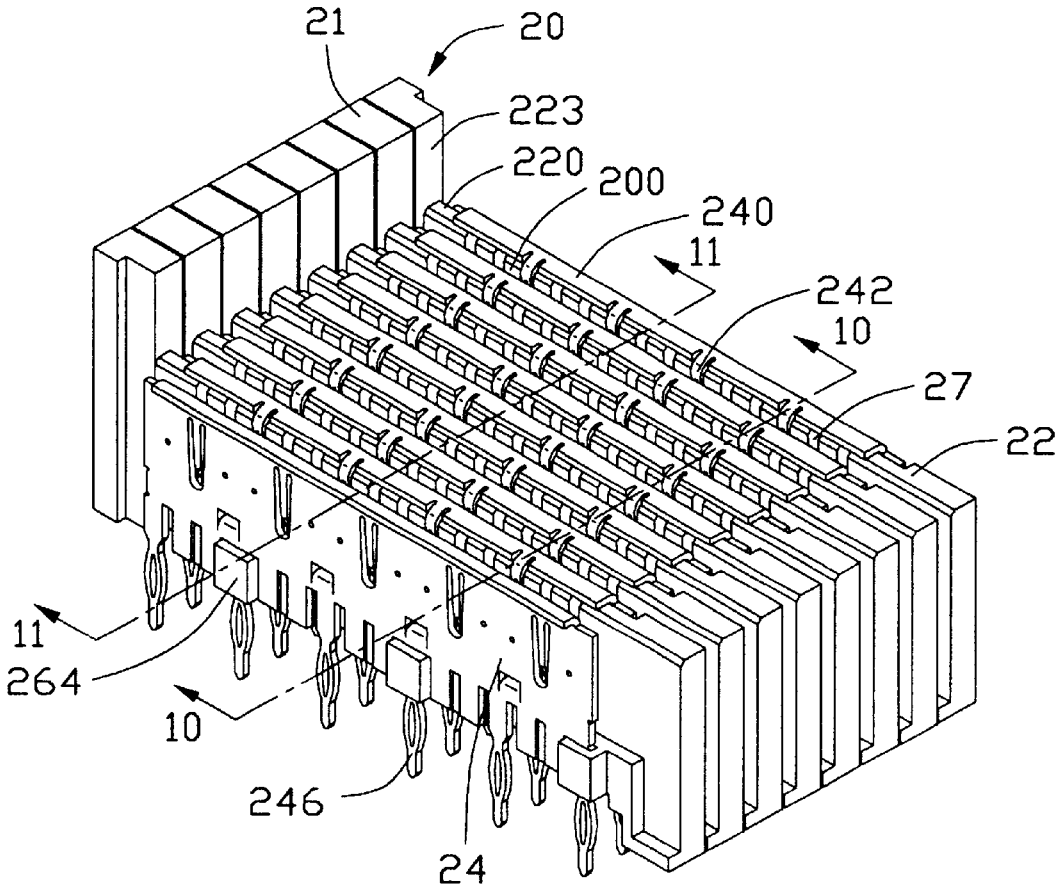
FIG. 9 is a perspective view showing a number of the wafer of FIG. 7 assembled together.
Figure 10:
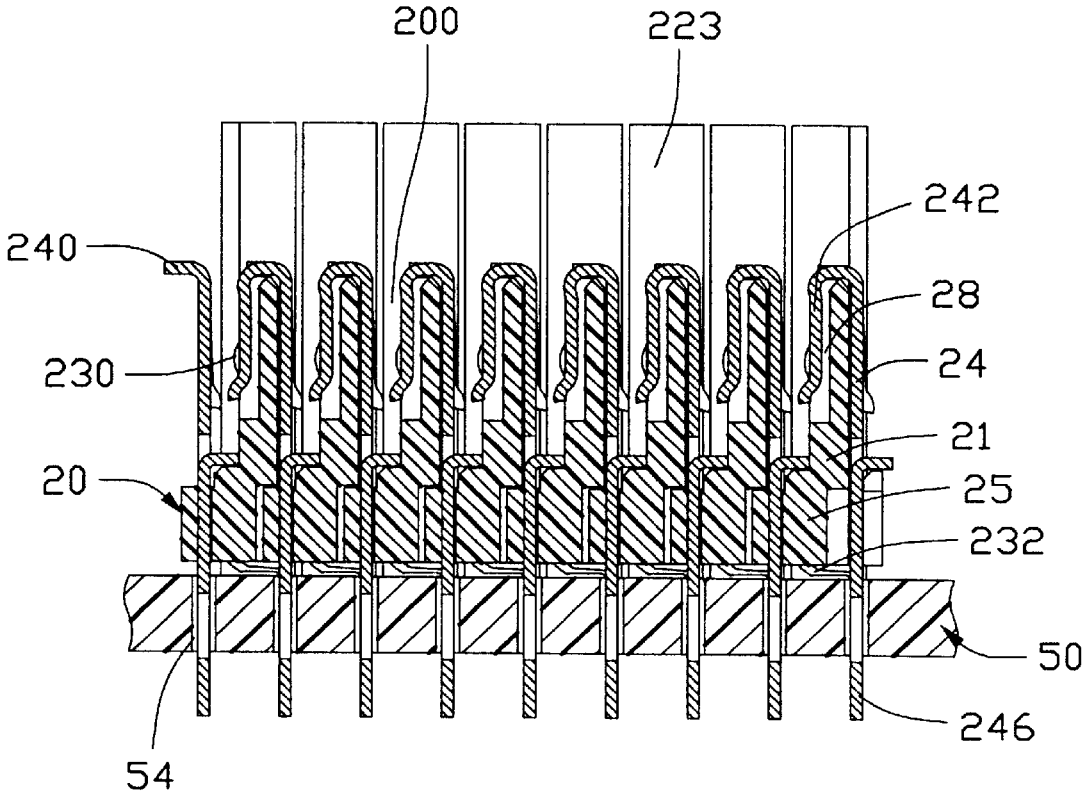
FIG. 10 is a cross-sectional view taken along section line 10—10 of FIG. 9 with the assembled wafers mounted on the daughter card.
Figure 11:
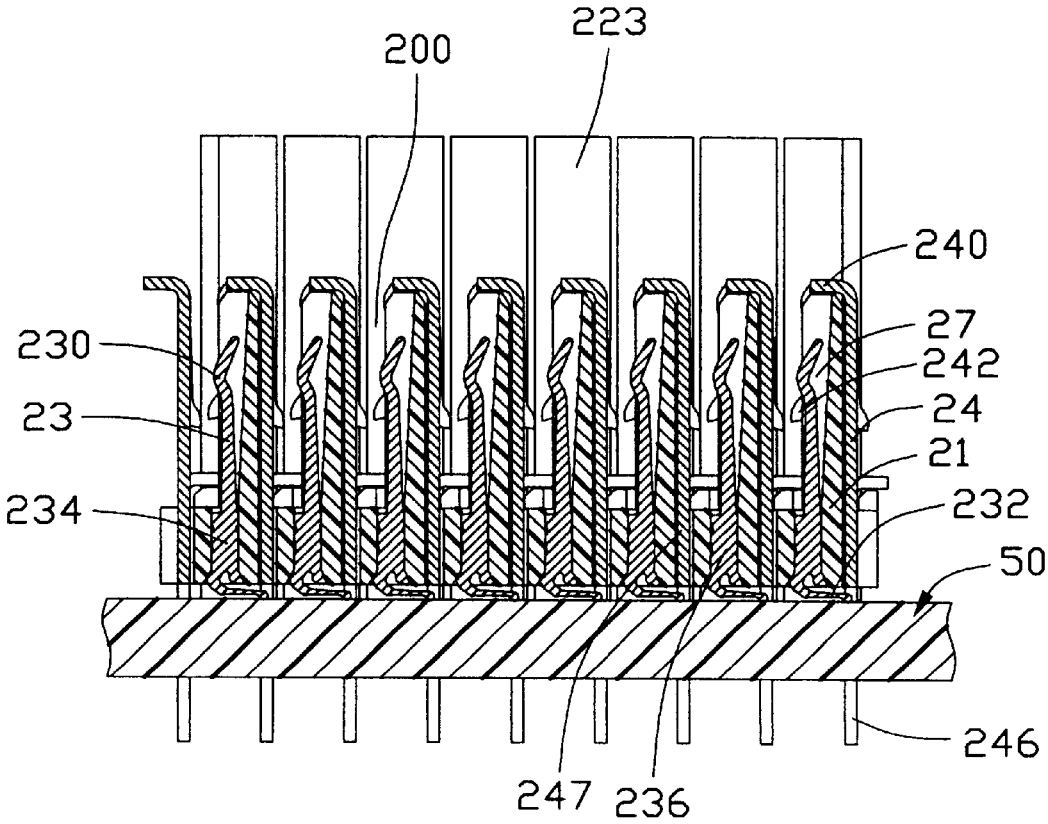
FIG. 11 is a view similar to FIG. 10 but taken along section line 11—11 of FIG. 9.

Referring to FIGS. 9–11 in conjunction with FIGS. 7 and 8, the plurality of wafers 21 are assembled together to form the spacer 20. A plurality of parallel slots 200 is defined between adjacent wafers 21 for receiving the circuit a boards 30. When assembling, the shoulders 2220 of the wafers 21 are aligned with each other, and the first blocks 25 of each wafer 21 have an interferential fit with corresponding recesses 266 formed between the second blocks 26 of an adjacent wafer 21.

Subsequently, the plurality of signal terminals 23 and the grounding buses 24 are assembled onto the spacer 20 to thereby make each wafer 21 with the signal terminals 23 received in the slots 27 in the side surface 2200, and with the grounding bus 24 disposed on the side surface 2202 of the wafer 21. The signal terminals 23 are stamped from a single piece of metal sheet. Each signal terminal 23 includes a curved contacting portion 230 raised outside of the side surface 2200 of the dielectric base 22 for contacting with the signal traces of an inserted circuit board 30, a bent tail portion 232 extending toward the side surface 2202 of the dielectric base 22, and an intermediate portion 234 interconnecting the contacting portion 230 with the bent tail portion 232. The signal terminal 23 has an end portion 236 (FIG. 11) near the bent tail portion 232 thereof. There exists a clearance (not labeled) between the bent tail portion 232 and the bottom surface 2204 of the dielectric base 22.

The grounding bus 24 is formed as a single piece thereby snugly bearing against the side surface 2202 of the corresponding dielectric base 22. The grounding bus 24 has a top flange 240 covering the top edge 224 of the body portion 220, and a plurality of contacting legs 242 depending downwardly from the top flange 240 into corresponding recesses of the dielectric base 22. Particularly referring to FIG. 11, a top end of each contacting leg 242 has an arced configuration to thereby function as a lead-in for facilitating insertion of the circuit board 30 into a corresponding slot 200. In addition, the grounding bus 24 has press-fit tails 246 for fittingly engaging with the daughter card 50. The tails 246 have a number which is the same as a total number of the first and second blocks 25, 26 of the wafer 21. The press-fit tails 246 extend beyond the bottom surface 2204 of the dielectric base 22 through apertures 250, 2640 respectively defined in the first blocks 25 of the wafer 21 and the second blocks 26 of an adjacent wafer 21. Between two neighboring press-fit tails 246, the grounding bus 24 forms two flaps 247 at a lower part thereof and a slot 248 between the two flaps 247. Each flap 247 has a bottom face thereof substantially flush with the bottom surface 2204 of the dielectric base 22 and are received in recesses 268 in the second blocks 26 of an adjacent wafer 21. The slots 248 of the grounding bus 24 receive the ribs 262 of the second blocks 26 of the adjacent wafer 21 when the two wafers 21 are assembled together. More importantly, the flaps 247 of the grounding bus 24 are disposed between the signal terminals 23 mounted on the two adjacent wafers 21 for functioning as shielding near the end portions 236 (FIG. 11) of the signal terminals 23.

Referring back to FIGS. 1–5, each of the circuit boards 30 has a mating portion 300, a mounting portion 302 and a rearward edge 304. After the spacer 20 is formed, the circuit boards 30 are respectively inserted into the slots 200 formed between the wafers 21. The mounting portion 302 of the circuit board 30 is received in a corresponding slot 200 and electrically contacts with the signal terminals 23 and the grounding bus 24 of the wafer 21. The contacting portions 230 of the signal terminals 23 electrically contact with the signal traces on the circuit board 30, and the contacting legs 242 of the grounding bus 24 electrically contact with the grounding traces on the circuit board 30. The rearward edges 304 of the circuit boards 30 abut against the shoulders 2220 of dielectric bases 22.

The spacer 20 with the parallel circuit boards 30 received therein is then mounted to the dielectric housing 10 in a back-to-front direction. The spacer 20 is received in the opening 13 of the housing 10. The channels 14 of the housing 10 guide the mating portions 300 of the circuit boards 30 into the mating port 12 of the housing 10. Finally, the fastening device 40 is attached to the housing 10 for fixing the spacer 20 with the housing 10. The fastening device 40 includes a rear wall 400 covering with the rear face 102 of the housing 10, and a pair of latches 402 forwardly extending from opposite side edges of the rear wall 400. Each latch 402 has a hook 404 at a free end thereof. The latches 402 are received in the recesses 15 of the housing 10 and the hooks 404 are locked in the cavities 16 of the housing 10. The rear wall 400 has a protrusion 406 on an inner face thereof for abutting against a top face of the depression 2222 of the spacer 20, whereby the housing 10 and the spacer 20 are stably connected with each other. A cylinder pin 60 is inserted into through holes 32 of the circuit boards 30 through the aperture 17 of the housing 10 for keeping the circuit boards 30 in their original position rather than be pushed back when the connector 1 mates with the complementary connector 8.

Figure 2:
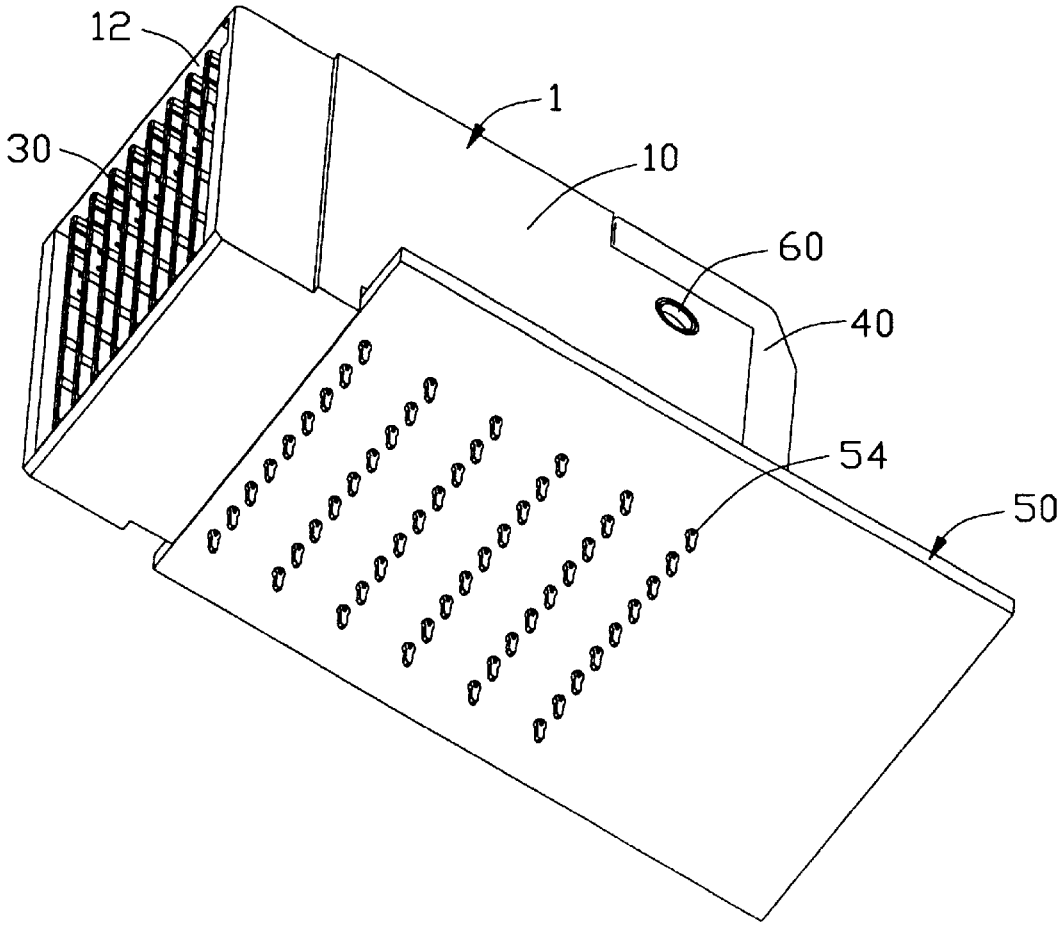
FIG. 2 is a view similar to FIG. 1 but taken from a different perspective.
Figure 3:
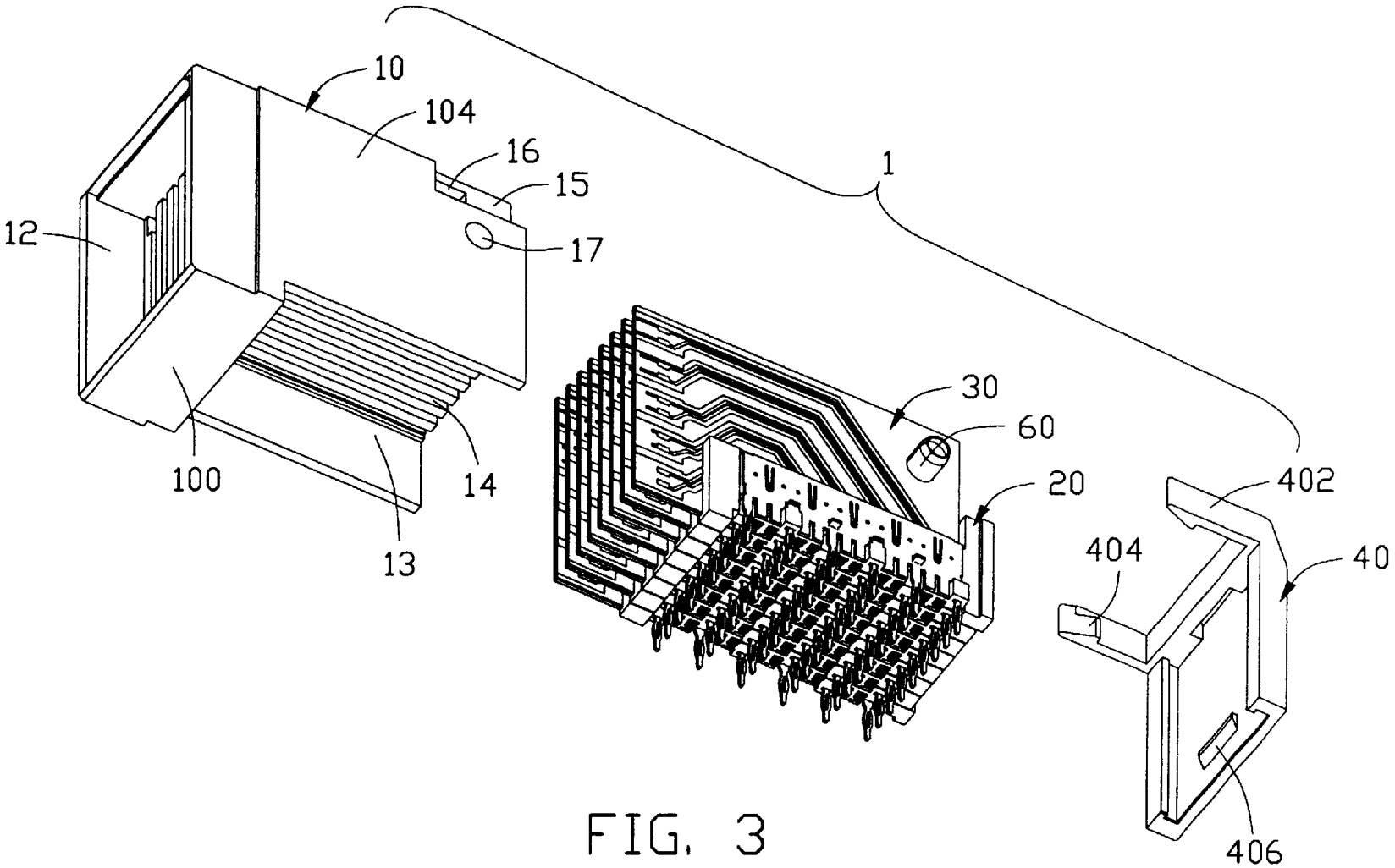
FIG. 3 is a partially exploded view of the connector of the present invention.
Figure 4:
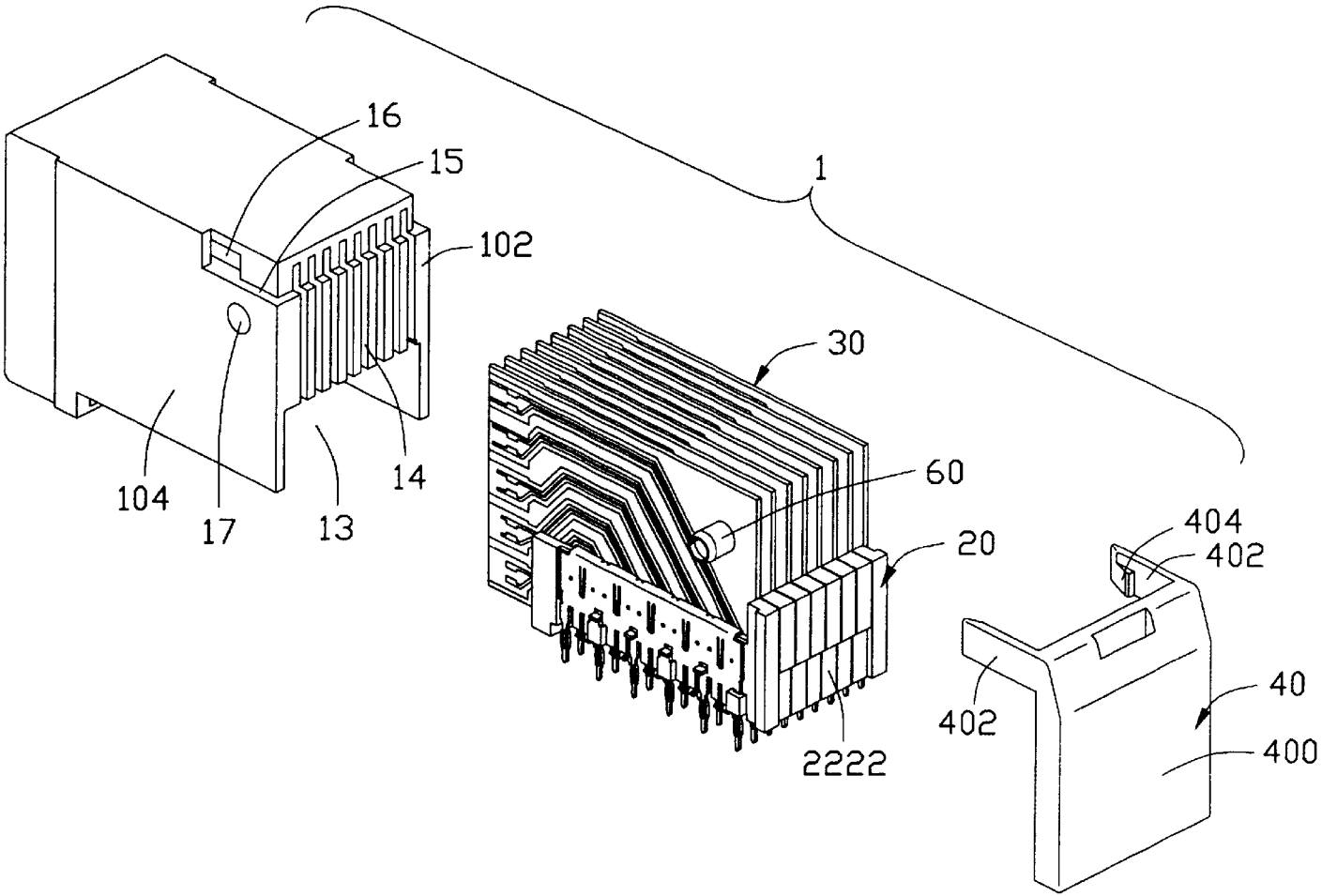
FIG. 4 is a view similar to FIG. 3 but taken from a different perspective.
Figure 5:
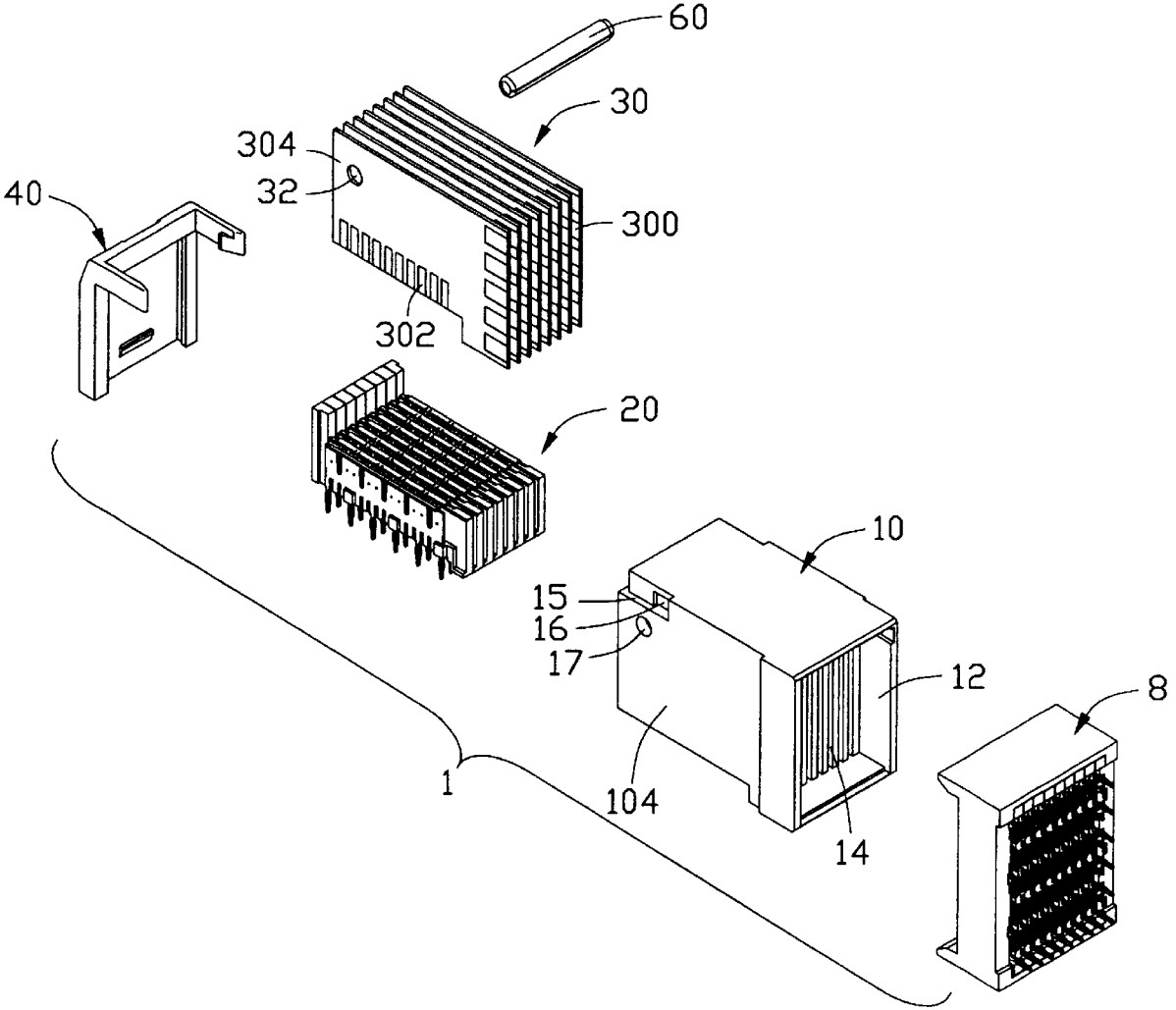
FIG. 5 is an exploded view of the connector of the present invention and a complementary connector.
Figure 12:
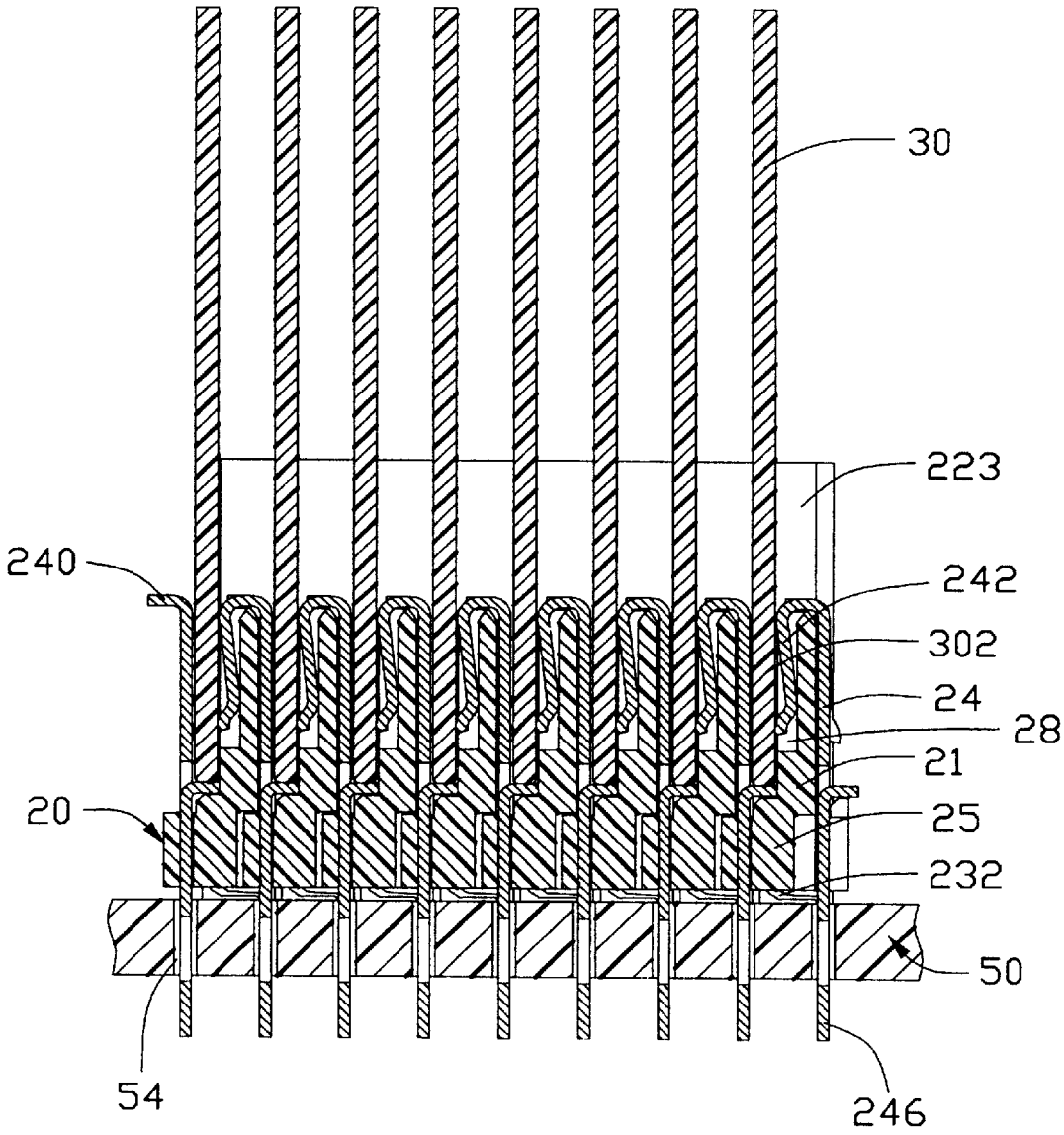
FIG. 12 is a view similar to FIG. 10 with circuit boards being inserted into the assembled wafers.

Referring to FIGS. 10–12 in conjunction with FIGS. 1–2, the connector 1 is mounted on the daughercard 50 to establish an electrical connection therebetween. The press-fit tails 246 of the grounding bus 24 are interferentially received in plated through holes 54 of the daughter card 50. The press-fit tails 246 of the grounding bus 24 not only establish grounding traces between the connector 1 and the daughter card 50, but also sufficiently hold the connector 1 against movement relative to the daughter card 50. At the same time, the bent tail portions 232 of the signal terminals 23 are compressively engaged with signal pads (not shown) on the daughter card 50 for establishing signal traces between the connector 1 and the daughter card 50.

It is noted that the connector 1 has a plurality of grounding buses 24 disposed between adjacent rows of the signal terminals 23, and each of the circuit boards 30 located between adjacent rows of the signal terminals 23 has the grounding traces and the grounding planes respectively on the opposite sides of the circuit board. Both the grounding buses 24 and the grounding traces and the grounding planes on the circuit boards 30 function as shielding between adjacent rows of the signal terminals 23. Furthermore, each grounding bus 24 has the plurality of flaps 247 formed at a bottom edge thereof. Each flap 247 of the grounding bus 24 is aligned with predetermined end portions 236 of the signal terminals 23. The flaps 247 of the grounding bus 24 are disposed between the end portions 236 of the signal terminals 23 of two adjacent rows for preventing crosstalk between the end portions 236, thereby ensuring better signal transmission performance of the connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a printed circuit board, comprising:

a plurality of individual wafers assembled together to define a plurality of slots therebetween adapted for receiving a plurality of circuit boards in the slots, each wafer including a dielectric base and a plurality of signal contacts and a grounding bus respectively mounted on opposite sides of the dielectric base, the grounding bus having a plurality of flaps adjacent to a bottom edge thereof, each signal contact having an end portion aligned with a corresponding flap of the grounding bus, the flaps being disposed between the end portions of the signal contacts of adjacent rows for functioning as shielding between the end portions, the end portions being located near tail portions of the signal contacts, the tail portions being adapted for electrically contacting with the printed circuit board;

wherein each wafer has a bottom surface flush with the bottom edge of the grounding bus, the grounding bus having a plurality of tail portions extending downwardly beyond the bottom surface of each wafer adapted for connecting to the printed circuit board;

wherein the flaps of the grounding bus are formed between the tail portions thereof;

wherein the tail portions of the signal contacts each have a bent configuration for compressively contacting the printed circuit board;

wherein the grounding bus defines a plurality of slots between the flaps thereof;

wherein each wafer has a plurality of first and second blocks respectively on the opposite sides thereof in a staggered manner, and the first blocks of each wafer are interferentially fitted with recesses formed between adjacent second blocks of an adjacent wafer;

wherein the second blocks of each wafer define a plurality of recesses therein, the flaps of the grounding bus of an adjacent wafer being received in the recesses, and the second blocks having a plurality of ribs received in the slots of the grounding bus of the adjacent wafer;

wherein a number of the tail portions of the grounding bus is the same as a total number of the first and second blocks on the opposite sides of each wafer;

wherein the tail portions of the grounding bus extend through the first blocks of each wafer as well as the second blocks of the adjacent wafer.

* * * * *